United States Patent [19]

Baron et al.

[11] 3,976,211

[45] Aug. 24, 1976

[54] MOTION LIMIT SYSTEM FOR POWER SHOVELS

[75] Inventors: George B. Baron; Paul W. Padrutt, both of Marion, Ohio

[73] Assignee: Marion Power Shovel Company, Inc., Marion, Ohio

[22] Filed: Nov. 7, 1974

[21] Appl. No.: 521,908

[52] U.S. Cl. ..... 214/138 R; 214/762

[51] Int. Cl.[2] ..... E02F 3/32

[58] Field of Search ..... 214/135, 138 R, 762, 214/763, 764

[56] References Cited

UNITED STATES PATENTS

| | | | |
|---|---|---|---|
| 3,197,051 | 7/1965 | Thickpenny | 214/764 |
| 3,204,794 | 9/1965 | Washbond | 214/762 |
| 3,429,471 | 2/1969 | Austin et al. | 214/763 |
| 3,539,068 | 11/1970 | Seaberg | 214/764 |
| 3,713,557 | 1/1973 | Seaberg et al. | 214/763 |
| 3,856,161 | 12/1974 | Baron | 214/138 |

*Primary Examiner*—Robert J. Spar
*Assistant Examiner*—Ross Weaver
*Attorney, Agent, or Firm*—Mason, Fenwick & Lawrence

[57] ABSTRACT

In a power shovel having a crowd system for crowding and retracting a dipper and a hoist system for hoisting and lowering such a dipper, a system for limiting the motion of the dipper generally comprising means operatively interconnecting a crowd component movable between predetermined crowd and retract limits and crowd control lever responsive to a movement of the crowd component between the pedetermined limits of movement thereof for increasingly biasing the crowd control lever steadily away from an operative position thereof, as the crowd component approaches one of the predetermined limits of movement thereof, means operatively interconnecting a hoist control lever and a hoist component movable between predetermined upper and lower limits responsive to a movement of the hoist component between the limits of movement thereof for increasingly biasing the hoist control lever steadily away from an operative position thereof as the hoist component approaches one of the predetermined limits of movement thereof, and means operatively connected to the hoist control lever responsive to predetermined angular displacements of an upper frame of the shovel relative to a lower frame thereof for conditioning the hoist control lever biasing means to advance in time the biasing of the hoist control lever away from the lowering position thereof.

34 Claims, 15 Drawing Figures

Fig-8
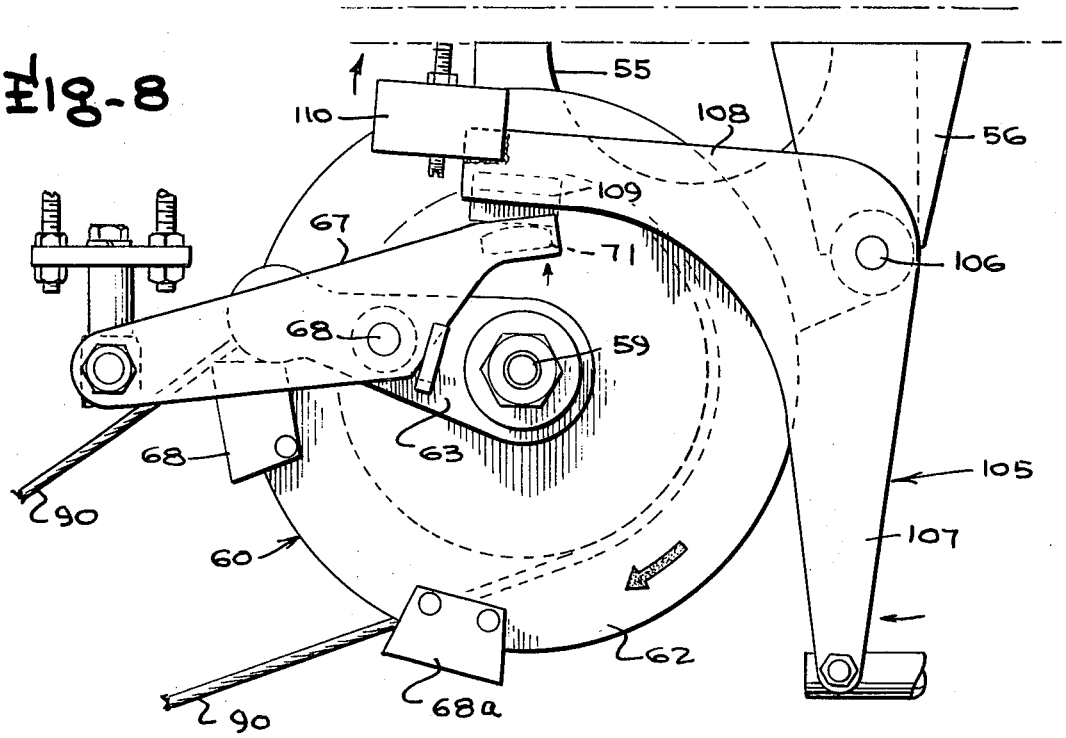
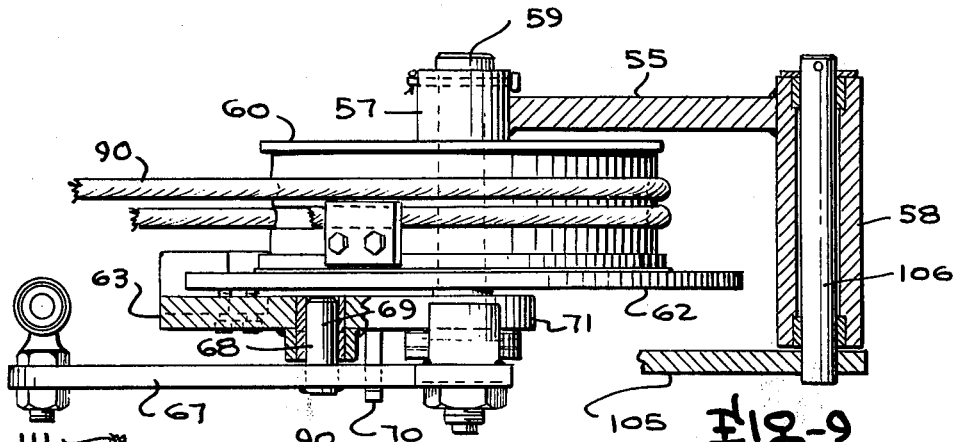
Fig-9
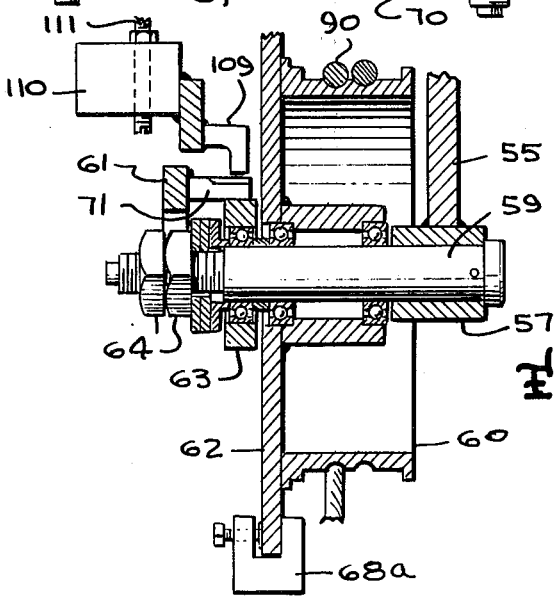
Fig-10

MOTION LIMIT SYSTEM FOR POWER SHOVELS

This invention relates to a motion limit system for a power shovel and more particularly to a system for assisting an operator in controlling the motions of a dipper during a conventional digging cycle of a power shovel.

In conventional power shovels of the stripping or loading type, there normally is provided a lower frame mounted on a propulsion device such as a pair of crawler units; an upper frame rotatably mounted on the lower frame; a front end assembly including a stiffleg pivotally connected to the front end of the upper frame, a dipper handle operatively connected to the stiffleg for pivotal movement relative thereto and a dipper pivotally connected to the dipper handle; a crowd system mounted on the upper frame and operatively connected to the front end assembly for crowding and retracting the dipper; a hoist system mounted on the upper frame and operatively connected to the front end assembly for hoisting and lowering the dipper; and machinery mounted on the upper frame and operatively connected to the lower frame for rotating the upper frame relative to the lower frame and correspondingly swinging the dipper. Usually, such machines are provided with crowd, hoist and swing control levers which may be operated manually to impart single or compound motions to the dipper during a normal digging cycle.

Because of structural limitations, the crowd, retract, hoist and lowering motions of the dipper are restricted within predetermined limits. In order to obtain maximum efficiency in the operation of such machines, it is required that the dippers be extended their full lengths of travel without exceeding the limits which could result in structural damage to the dipper and other components of the machine. In the prior art, it has been the conventional practice to employ limit switches as a means of detecting the approach of the dipper to a motion limit for the purpose of either warning the operator or automatically stopping or reversing the motion of the dipper. It has been found, however, that the use of limit switches and associated systems for either warning the machine operator and/or effecting a stopping or reversing action of the dipper motion, has not been sufficiently effective in performance and particularly in increasing the operating efficiency of such shovels.

Accordingly, it is the principal object of the present invention to provide a novel motion limit system.

Another object of the present invention is to provide a novel system for limiting the motion of a dipper of a power shovel.

A further object of the present invention is to provide a novel system for limiting the crowd, retract, hoist and lowering motions of the dipper of a power shovel.

A still further object of the present invention is to provide a novel system for limiting the motions of a dipper of a power shovel while the dipper is subject to single or compound motions as it is cycled through an ordinary digging cycle.

Another object of the present invention is to provide a novel system adapted for use on a power shovel which is effective in preventing the operator thereof from driving the dipper accidentally beyond the motion limits of the dipper yet allowing him to cause the dipper to approach such limits closely and safely.

A further object of the present invention is to provide a novel system for limiting the motions of the dipper of a power shovel which provides the operator thereof with an effective warning of the approach of such limits which he cannot ignore, such warning occuring sooner as a function of the speed at which the dipper is approaching the limit.

A still further object of the present invention is to provide a novel motion limit system for dippers of power shovels having manually operated crowd and retract, hoist and lowering and swing levers.

Another object of the present invention is to provide a novel system for limiting the motions of the dipper of a power shovel utilizing manually operated crowd and retract, hoist and lowering and swing levers wherein the crowd and retract lever is caused to seek automatically a position required to hold a load motionless when the operator removes his hands from such lever.

A further object of the present invention is to provide a novel motion limit system for power shovels which permits the operator to run the hoist up until sheaves mounted on the front end assembly thereof and at the base of the stiffleg approach each other safely without exceeding such limits. A still further object of the present invention is to provide a novel motion limit system for power shovels which allows the operator to run the hoist down until the dipper approaches the base of the stiffleg.

Another object of the present invention is to provide a novel system for auatomatically raising the lowering limit of the dipper of a power shovel whereby the dipper is prevented from striking the protruding ends of the crawler units of the machine.

A further object of the present invention is to provide a novel motion limit system for a power shovel, which is comparatively simple in design, relative inexpensive to manufacture and effective and reliable in performance.

Other objects and advantages of the present invention will become more apparent to those persons having ordinary skill in the art to which the present invention pertains, from the following description taken in conjunction with the accompanying drawings wherein:

FIG. 8 is a view similar to the view shown in FIG. 7, illustrating the components thereof in altered positions;

FIG. 9 is a cross-sectional view taken along line 9—9 in FIG. 7;

FIG. 10 is a cross-sectional view taken along line 10—10 in FIG. 7;

Figure 2:
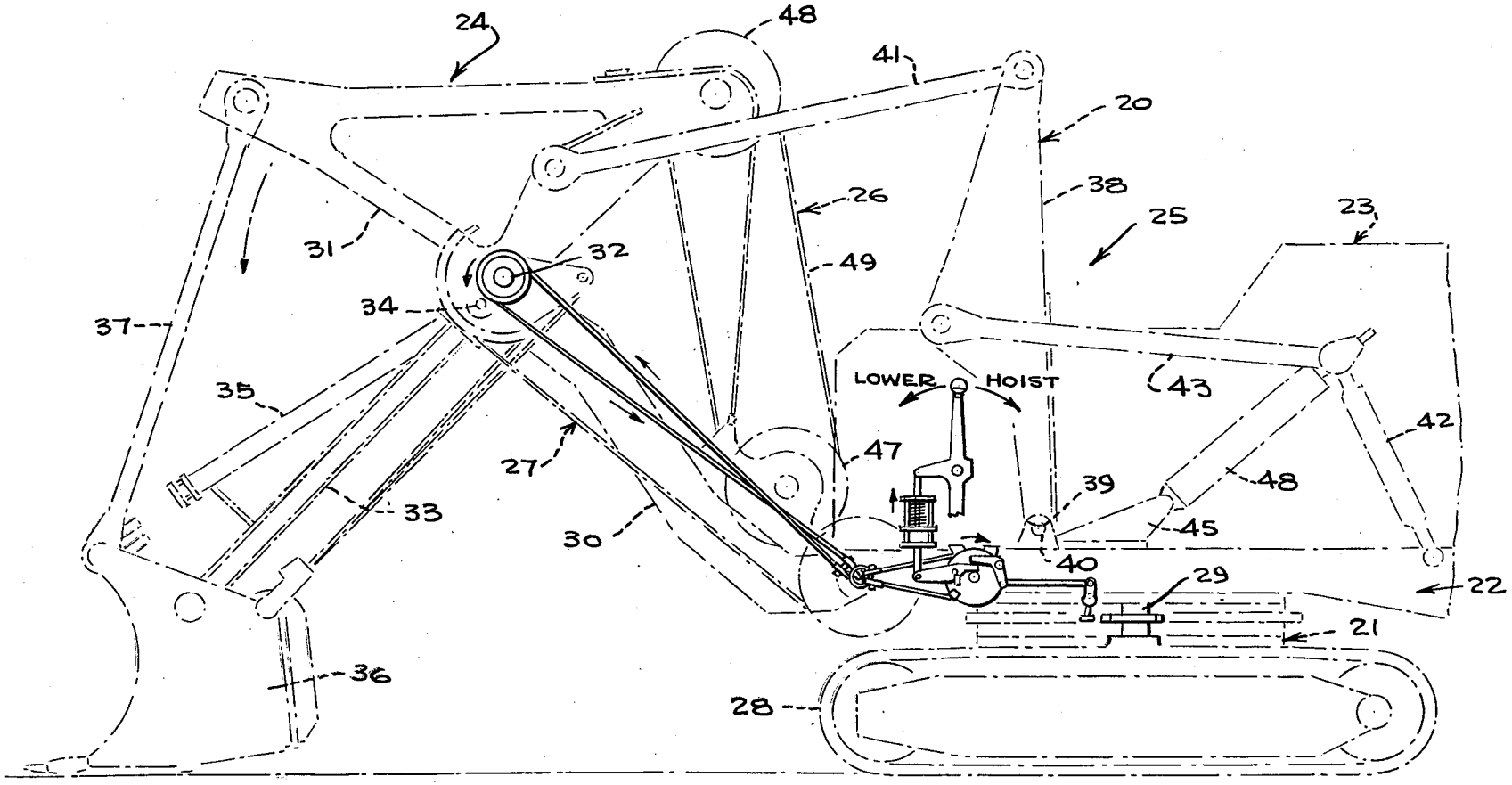
FIG. 2 is a side elevational view of a power shovel in phantom lines, illustrating the embodiment shown in FIG. 1, diagrammatically, installed on such shovel.

Referring to FIG. 2 of the drawings, there is illus-rated a power shovel 20 on which the present inven-on may be installed. Generally, the shovel consists of lower frame 21, an upper frame 22 rotatably mounted n the lower frame, a housing structure 23 mounted on ıe upper frame, a front end assembly 24 mounted on ıe front end of the upper frame, a crowd system 25 ıounted on the upper frame partially within the hous-ıg structure, operatively connected to the front end ssembly, a hoist system 26 mounted on the upper ame and operatively connected to the front end as-embly, a dipper pitch control mechanism 27 mounted n the front end of the upper frame and the front end ssembly, and machinery mounted on the upper frame ›r operating a propulsion unit mounted on the lower ame, the crowd and hoist systems and a mechanism ›r rotating the upper frame relative to the lower ame.

The lower frame essentially consists of a structural amework provided with a pair of transversely spaced rawler units 28, a center journal 29 and a roller circle isposed concentrically with the center journal. The pper frame also consists of a structural framework and supported on the roller circle provided on the lower ame for rotational movement about the center jour-al. The front end assembly basically consists of a stif-eg 30 pivotally connected at a lower end thereof to ıe front end of the upper frame, a hoist frame 31 ivotally connected on a head shaft 32 provided on the uter end of the stiffleg, a dipper handle 33 pivotally ›nnected to the hoist frame as at 34, provided with a itch stop 35, a dipper 36 pivotally mounted on the free ıd of the dipper handle and being capable of pitching ›wardly into engagement with the pitch stop, and the ›ist link 37 pivotally connected at the ends thereof to ıe hoist frame and the dipper.

The crowd system includes a mast 38 pivotally con-ected at is lower end to a set of brackets 39 by means a pin 40, for movement in a longitudinally disposed, ›rtical plane. A pair of connecting links 41 are pivot-ly connected at a rearwardly disposed set of ends ereof to the upper end of the mast and at forwardly sposed ends thereof to the hoist frame. The crowd stem further is provided with a pair of rearwardly sposed support links 42 pivotally connected at the wer ends thereof to the rear end of the upper frame, pair of drive links 43 pivotally connected at the ends ereof to the support links and to the mast intermedi-e the upper and lower ends thereof, and a pair of ›draulic cylinders 44 pivotally connected at the lower ıds thereof to brackets 45 rigidly secured to the upper ame, and pivotally connected at the upper ends ereof to the support links 42 or connecting links 43 ljacent the pivotal connections thereof.

Figure 1:
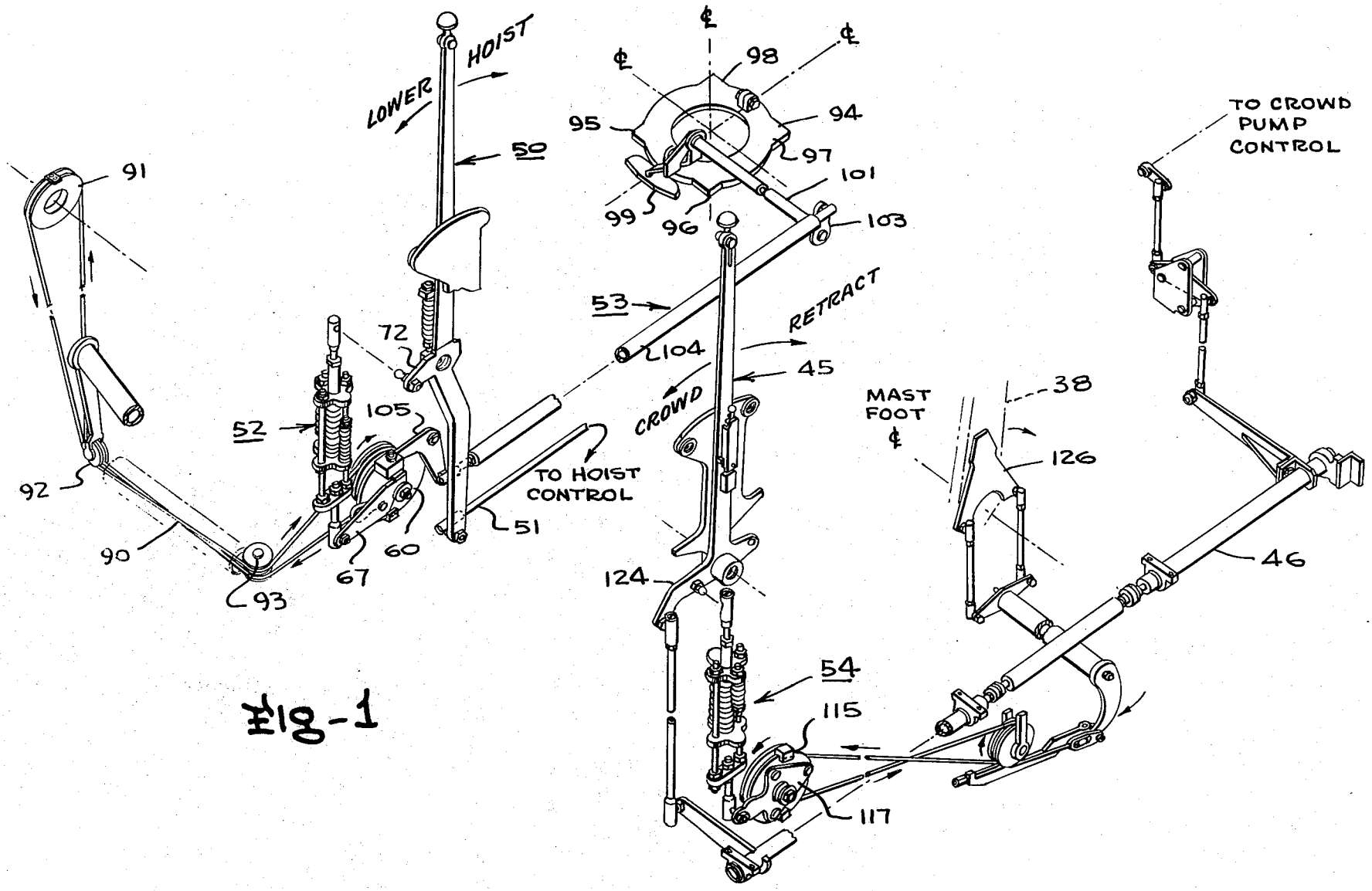
FIG. 1 is a perspective view of an embodiment of the invention.

A hydraulic system is provided for supplying fluid under pressure to opposite ends of the hydraulic cylinders 44 to extend and retract the cylinders and correspondingly pivot the mast to crowd or retract the front end assembly and correspondingly the dipper thereof. Such system includes a crowd control lever 45, as best illustrated in FIG. 2, which is operatively connected by a linkage 46 to a stroke control lever on an axial piston pump which determines the volume and direction for hydraulic fluid supported to cylinders 44. Crowd control lever 45 is pivotally connected at the lower end thereof to the upper frame and is manually operated. It is provided with a forwardly disposed crowd position, a rearwardly disposed retract position and an intermediate neutral position. As illustrated in FIG. 1, the lever is located at the operator's station within the housing structure.

The hoist system generally includes a hoist drum mounted on the upper frame within the housing structure and operated by hoist machinery, a sheave 47 mounted at the foot of the stiffleg, a sheave 48 mounted on the hoist frame, and a hoist line 49 operatively interconnecting the hoist drum and sheaves 47 and 48. It will be appreciated that whenever the hoist line is either payed out or taken in, the hoist frame and correspondingly the dipper handle, dipper and hoist link will be caused to pivot about the head shaft mounted on the upper end of the stiffleg. The operation of the hoist system is provided by a hoist control lever 50, as best illustrated in FIG. 1, which is operatively connected by a linkage 51 to a hoist motor electric controller which determines the speed and direction of the rotation of the motor for the hoist drum. The hoist control lever also is located at the operator's station within the housing structure, adjacent the crowd control lever, and may be manipulated manually to a forwardly disposed lowering position, a rearwardly disposed hoist position and an intermediate neutral position.

Dipper pitch control mechanism 27 functions to maintain the dipper at a predetermined pitch during the crowding phase of the digging cycle of the shovel. The construction and operation of such mechanism is described in detail in U.S. Pat. Nos. 3,501,034, entitled Power Shovel, which issued on Mar. 17, 1970, and 3,648,864, entitled Dipper Pitch Control For Shovels, which issued on Mar. 14, 1972. Such patents and pending U.S. patent applications, Ser. Nos. 412,257, entitled Power Shovel, filed Nov. 2, 1973, and 477,022, entitled Power Shovel and Crowd System Therefor, filed June 6, 1974, further describe in detail the construction and operation of the type of shovel disclosed in FIG. 2.

Referring to FIG. 1, there is illustrated an embodiment of the invention which is mounted on the upper frame of the power shovel and functions to limit the motions of the dipper. The embodiment generally consists of a system 52 operatively interconnecting hoist frame 31 and hoist control lever 50 for increasingly biasing the hoist control lever steadily away from the hoist or lowering positions thereof as the hoist frame approaches its upper and lower limits of travel relative to the stiffleg, a system 53 for shifting the lower limit of travel of the hoist frame relative to the stiffleg, responsive to predetermined angular displacements of the upper frame relative to the lower frame, as when the stiffleg would be aligned with or adjacent to the front ends of the crawler units, and a system 54 operatively interconnecting mast 38 and crowd control lever 45 for increasingly biasing the crowd control lever steadily away from a crowd or retract position thereof as the mast and correspondingly the dipper approaches one of its limits of movements as it is being crowded or retracted.

Figure 6:
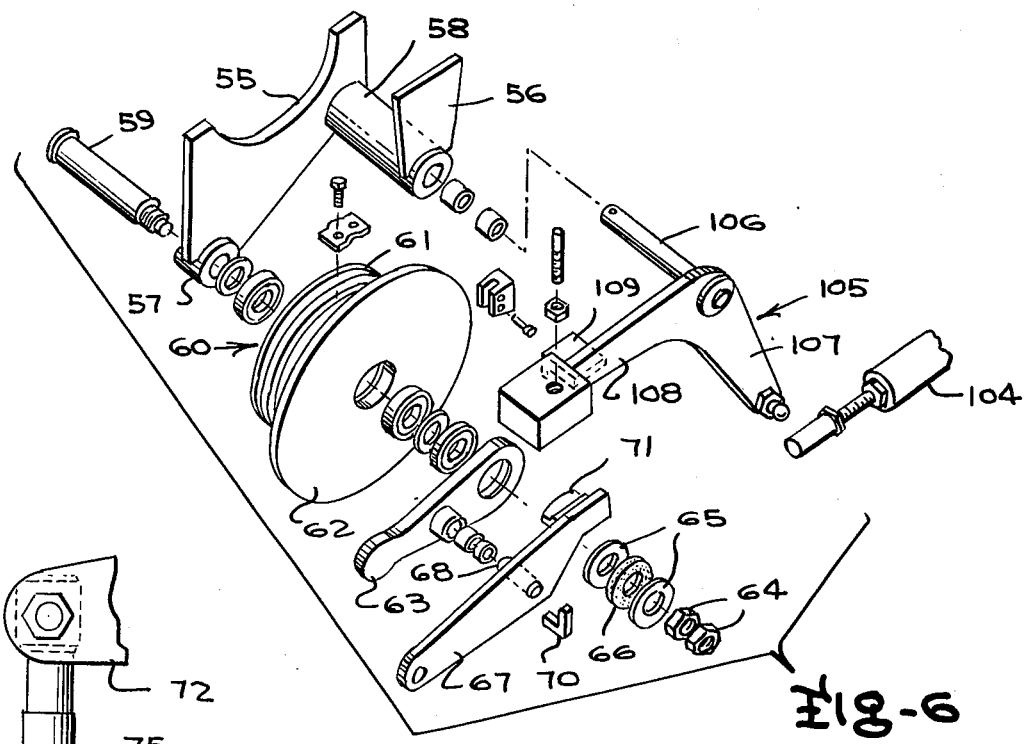
FIG. 6 is a perspective view of a hoist limit drum of the embodiment and associated components, illustrated in exploded relation.
Figure 7:
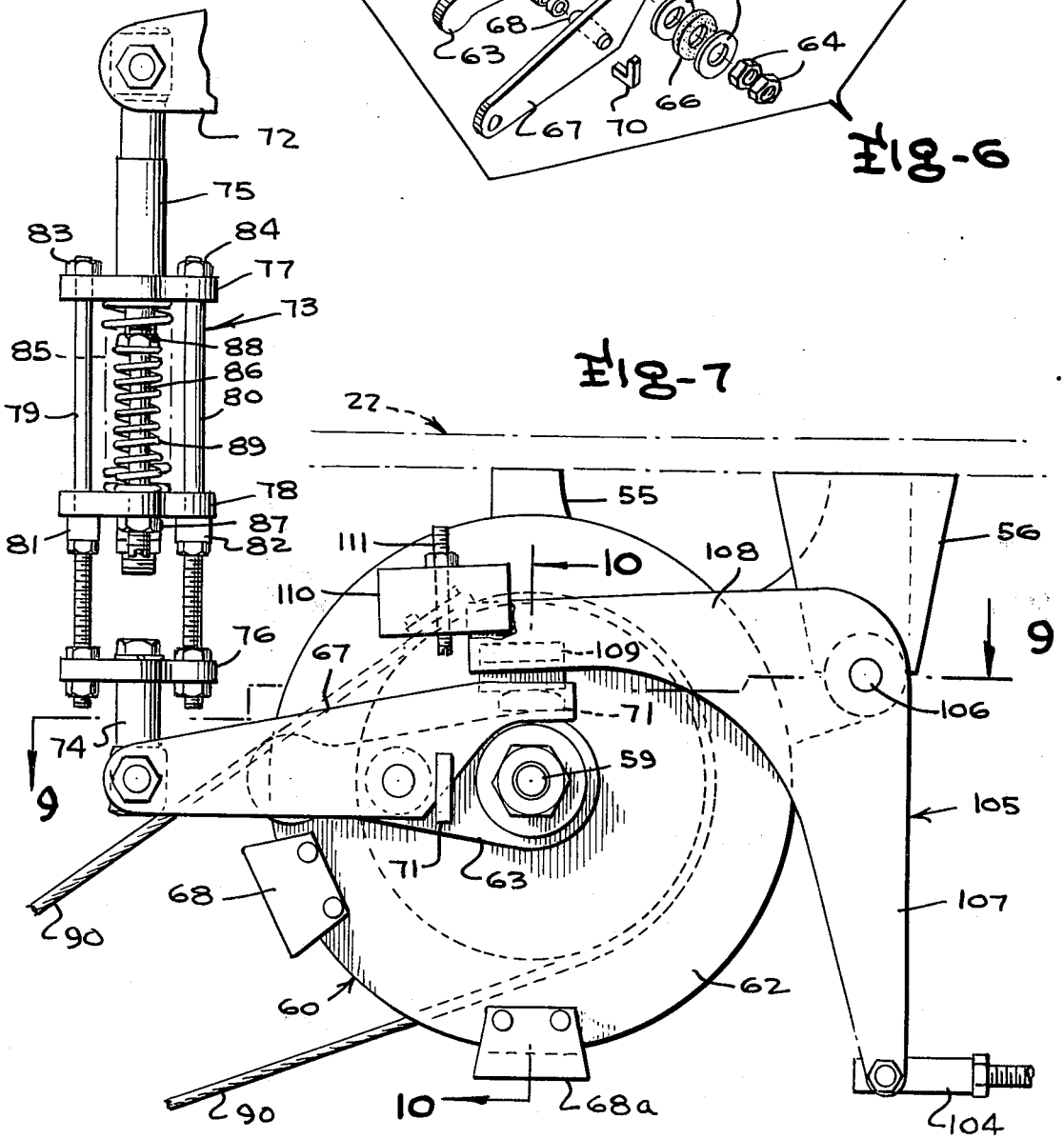
FIg. 7 is an enlarged, side elevational view of the hoist limit drum and associated components.

As best illustrated in FIGS. 1 and 6 through 10, the hoist control lever biasing system includes a pair of brackets 55 and 56 depending from the upper frame adjacent the operator's station which support a forwardly disposed shaft bearing 57 and a rearwardly disposed shaft housing 58. Supported in shaft bearing 57 is a transversely disposed shaft 59 on which there is rotatably mounted a hoist limit drum 60 provided with wire rope receiving recesses 61 and a circular end plate 62. Shaft 69 extends through drum 60 and further has rotatably mounted thereon an actuating lever 63 which extends radially relative to the axis of shaft 59. Actuating lever 63 is maintained adjacent the outer face of end plate 62 of the drum by means of a pair of nuts 64 threaded on the projecting threaded end of shaft 59. A pair of rigid washers 65 having a resilient washer 66 disposed between them are provided between lever 63 and nuts 64. As best shown in FIGS. 7 and 8, there is mounted on the periphery of circular end plate 62 a pair of circumferentially spaced limit stops 67 and 68 which are adapted to engage the end of actuating lever 63 when the hoist limit drum is rotated relative to the actuating lever. The limit stops are secured to end plate 62 by means of bolts to permit the adjustment of the angular displacement of the stops.

Mounted on actuating lever 63 is a floating lever 67 having a laterally projecting stub shaft 68 pivotally mounted within a shaft receiving opening 69 in actuating lever 63, intermediate the ends thereof. It will be appreciated that with such a mounting, floating lever 67 is adapted to be pivoted with the actuating lever about the axis of shaft 59 or pivoted about its own axis 68 relative to actuating lever 63. The pivotal movement of floating lever 67 relative to actuating lever 63 is limited in a clockwise direction by an L-shaped stop 70 mounted on actuating lever 63 adjacent shaft receiving opening 69, and engagable by the rearwardly disposed, underside of floating lever 67. The clockwise or downward movement of the rearwardly disposed portion of floating lever 67 relative to actuating lever 63 (as seen in FIGS. 7 and 8), further is limited by an abutment element 71 projecting transversely, inwardly from the end of floating lever 67 and engagable with a rearwardly disposed, upper side of actuating lever 63.

The forwardly disposed end of floating lever 67 is operatively connected to an arm portion 72 of the hoist control lever by means of a feedback linkage 73. As best shown in FIGS. 1 and 7, linkage 73 includes a pair of aligned links 74 and 75 pivotally mounted to the forwardly disposed end of floating lever 67 and universally connected by means of a ball and socket connection to lever arm portion 72, respectively, a pair of end plates 76 and 77 rigidly secured to links 74 and 75, a plate 78 disposed intermediate end plates 76 and 77, and a pair of guide rods 79 and 80 which are threaded at their lower end in end plate 76, pass through openings in intermediate plates 78 and pass through openings in end plate 77. As best illustrated in FIG. 7, guide rods 79 and 80 are provided with a pair of stop nuts 81 and 82 which are adapted to limit the downward movement of intermediate plate 78, and a pair of stop nuts 83 and 84 which are adapted to limit the upper movement of end plate 77 relative to the guide rods. Interposed between end plate 71 and intermediate plate 78 is a centrally disposed, preloaded compression spring 85 which engages and urges end plate 77 and intermediate plate 78 apart.

Passing through an opening in intermediate plate 78 is a guide rod 86 provided with a limit nut 87 engagable with the underside of plate 78 and a nut 88 mounted on the guide rod on the opposite side of plate 78. Provided on guide rod 86, between limit nut 88 and intermediate plate 78 in a secondary spring, the compressive force of which will be brought to bear against end plate 77 when center spring 85 is compressed sufficiently so that the end plate 77 engages limit nut 88. A similar secondary spring is mounted on the other side of the linkage wherein the guide rod is supported on end plate 77 and projects downwardly toward intermediate plate 78. Such other guide rod is provided with a limit nut which is adapted to engage intermediate plate 78 when center spring 85 has been compressed sufficiently, to bring to bear the biasing action of the other secondary spring. It will be appreciated from the construction of linkage 73 that a motion transmitted through the linkage will increase steadily as a function of the force applied and the composite spring rate of the linkage.

The pivotal motion of hoist frame 31 relative to stiffleg 30 is transmitted to the hoist limit drum by means of a wire rope 90 which passes around a drum 91 rigidly mounted on hoist frame 31 about head shaft 32, downwardly along the length of the stiffleg, around a sheave 92 mounted at the foot at the stiffleg, transversely and around a sheave 92 mounted on the upper frame and then rearwardly and around the hoist limit drum. With such an arrangement, it will be seen that whenever the hoist frame pivots relative to the stiffleg, such pivotal motion will be transmitted to the hoist limit drum.

Once the angular limits of movement of the hoist frame relative to the stiffleg have been determined, limit stops 68 and **68*a* on the end plate of the hoist limit drum can be set at a corresponding suitable angle apart. Under such circumstances, then, whenever the hoist frame pivots relative to the stiffleg and approaches a limit of angular displacement relative to the stiffleg, one of limit stops 68 and 68*a* will be caused to engage and pivot actuating arm 63. Then, depending on the relationship of floating lever 67 relative to actuating lever 63**, motion may be transmitted through the preloaded spring linkage to the hoist control lever to bias the lever away from either the hoist or lowering position toward the neutral position thereof.

Figure 4:
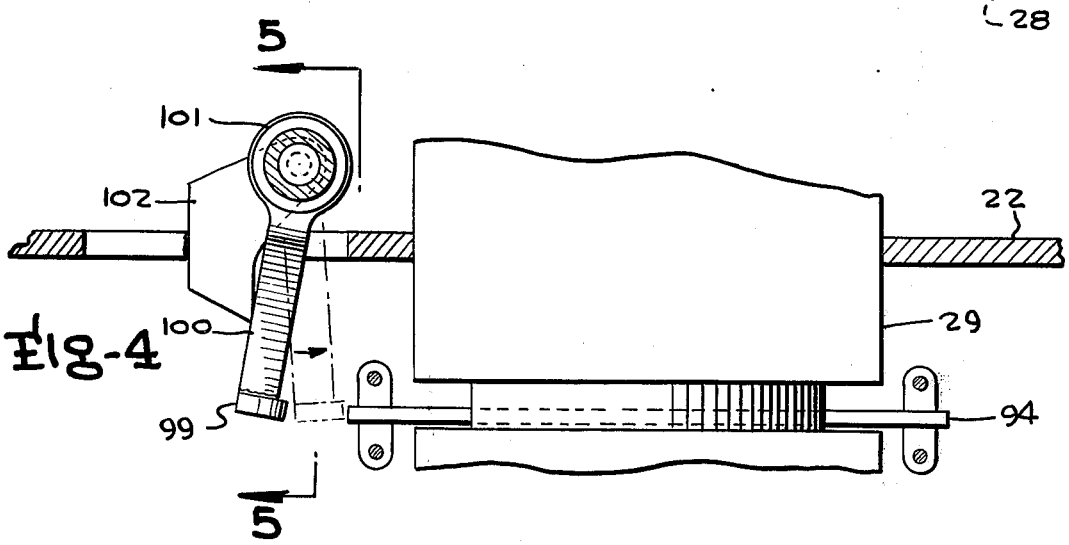
FIG. 4 is an enlarged, side view of the assembly illustrated in FIG. 3.
Figure 5:
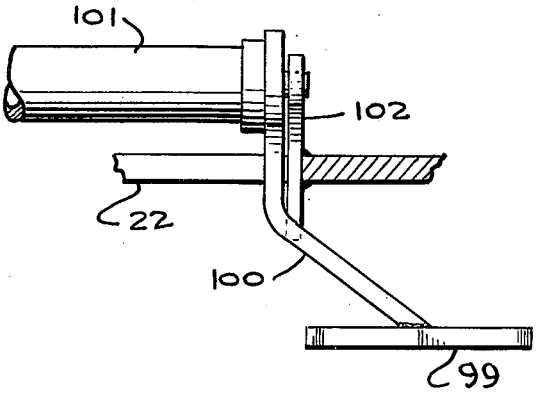
FIG. 5 is a cross-sectional view taken along line 5—5 in FIG. 4.

The transmission of motion from the hoist limit drum to the hoist control lever is a function not only of the position of the hoist frame relative to the stiffleg but also the operation of limit shifting system 53. As previously mentioned, such system senses the angular displacement of the upper frame relative to the lower frame and operates to shift the lowering limit of the hoist frame upwardly whenever the vertical plane of the stiffleg intersects the ends of the crawler units. To effect such operation, the system is provided with a horizontally disposed cam plate 94 rigidly clamped to the center journal, which is provided with a angularly spaced lobes 95 through 98 which are aligned with the front and rear ends of the crawler units. Such lobes are adapted to be engaged by a follower 99 provided on the lower end of a depending pivot arm 100. As best shown in FIGS. 4 and 5, the upper end of arm 100 is rigidly secured to a transversely disposed shaft 101 journaled in brackets such as bracket 102 rigidly secured to the upper frame. It will be appreciated that whenever follower 99 engages any of the lobes on cam plate 94, the follower will move radially relative to the center journal to correspondingly pivot shaft 101 about the axis of shaft 101.

As best illustrated in FIG. 1, the outer end of shaft 101 is provided with a radially disposed arm member 103. Pivotal movement of shaft 101 is transmitted forwardly through arm 103 by means of a forwardly extending link 104 which is pivotally connected at its forward end to a bell crank lever 105. Bell crank lever 105 is best illustrated in FIGS. 6 through 10. It is provided with a pivot shaft 106 journaled in shaft housing 58, a depending arm portion 107 connected to the front end of link 104 by means of a ball and socket connection, and a forwardly disposed arm portion 108 having a pad 109 engagable with abutment 71 on the rear end of floating lever 67.

Figure 3:
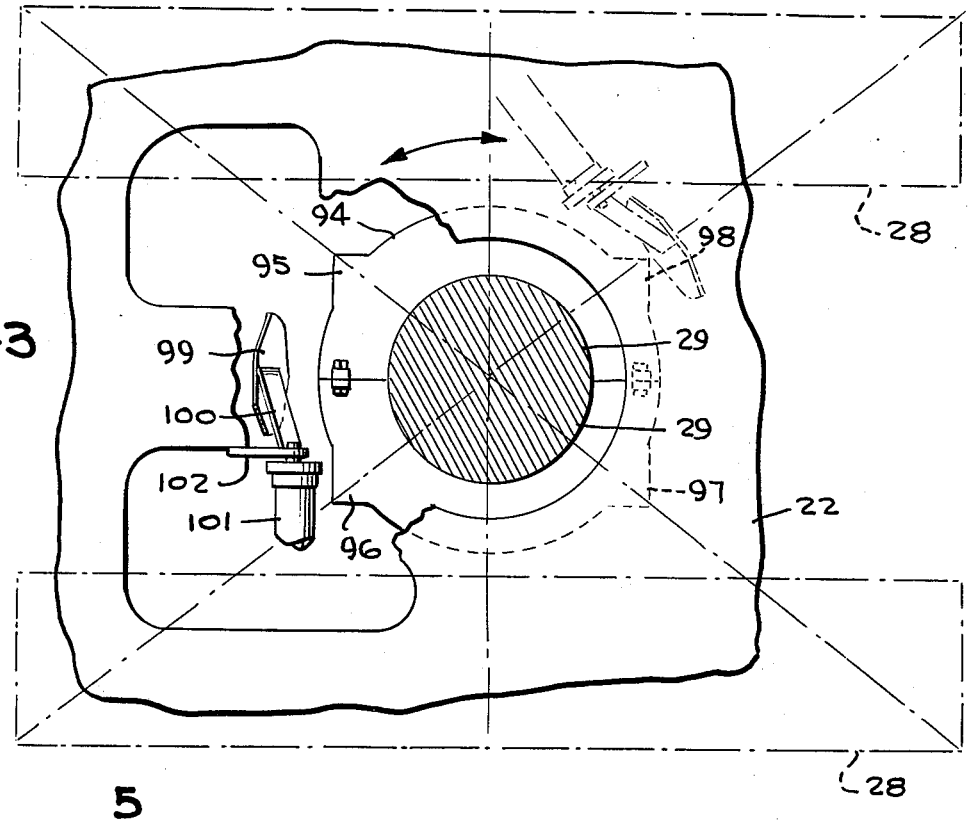
FIG. 3 is a top plan view of a fragment of the upper frame of the shovel shown in FIG. 2, illustrating several components of the embodiment associated with the center journal of the shovel.

It will be seen that whenever follower 99 engages a lobe of cam plate 94, the radially outward movement of the follower will cause shaft 101 to rotate about its axis, link 104 to move rearwardly and bell crank lever 105 to pivot in a counterclockwise direction relative to FIGS. 7 and 8 thus restricting the angular movement of floating lever 67 relative to actuating lever 63, as shown in FIG. 7, and correspondingly causing the floating lever to pivot with actuating lever 63 whenever either of limit stops 68 or **68*a* engage and pivot actuating lever 63. Furthermore, it will be noted that whenever follower 99 is in the position as illustrated in FIG. 3, as it would be whenever the dipper is in an elevated position clear of the ends of the crawler units, the follower will not engage the lobes of the cam plate and, correspondingly, bell crank lever 105 will not immediately cause the actuating and floating levers to coact. Clearance of the lobes by the follower is assured by means of of a counterweight 110 provided on the front end of bell crank arm 108 which causes the bell crank lever to pivot counterclockwise relative to FIGS. 7 and 8, and thus maintain the follower radially outwardly relative to the center journal. The clockwise movement of bell crank lever 105 also is restricted by means of an adjustable screw 111 threaded into counterweight 110 and engageable with a component of the upper frame. Such restricted clockwise movement of the bell crank lever correspondingly prevents follower 99 from engaging the cam plate other than lobes 95 through 98**.

Figure 15:
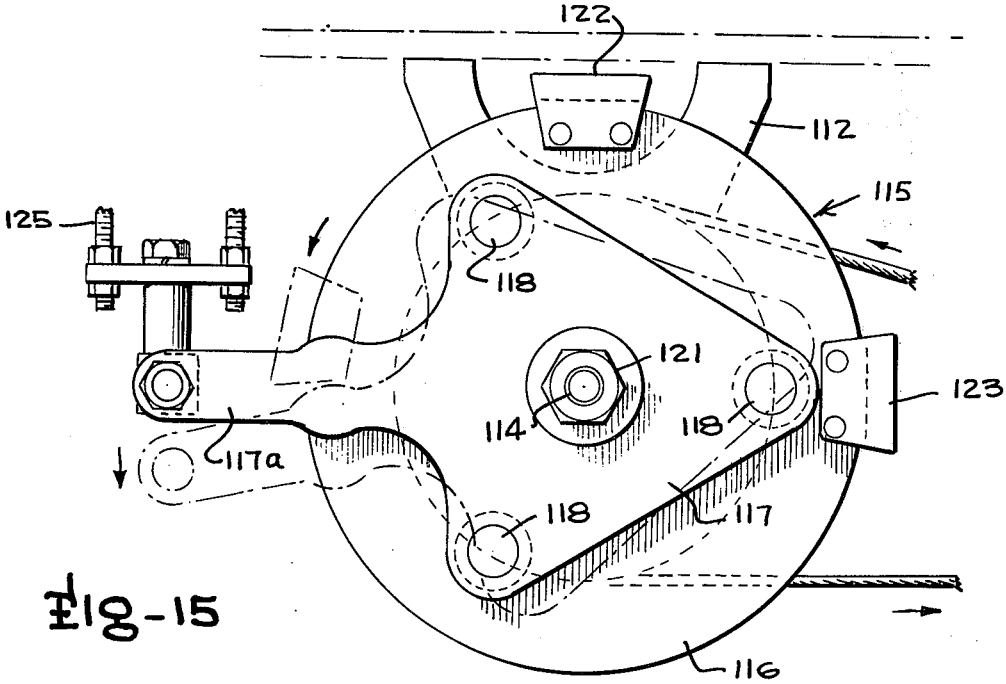
FIG. 15 is a side elevational of the crowd limit drum f the embodiment and associated components illus-rated in FIG. 14.

The crowd control lever biasing system is best illustrated in FIGS. 1 and 11 through 15. The system also is mounted on the upper frame and includes a bracket 112 depending from the upper frame adjacent the operator's station. Bracket 112 is provided with a shaft bearing 113 in which there is provided a laterally projecting mounting shaft 114. Mounted on the projecting end of shaft 114 is a crowd limit drum 115 provided with wire rope guiding grooves and a circular end plate 116. Also pivotally mounted on the outer end of shaft 114 is an actuating lever 117. Lever 117 is adapted to pivot relative to drum 115 and is provided with a plurality of resilient pads 118 which engage the outer surface of end plate 116 and are yieldably urged into engagement therewith by means of a pair of rigid washers 119 and an intermediate resilient washer 120 mounted on the end of shaft 114 and urged against lever 117 by means of a pair of nuts 121. The force exerted on the lever by nuts 121 is adjusted to provide a frictional drag of the lever relative to the drum. As best shown in FIG. 15, the periphery of end plate 116 of the hoist limit drum is provided with a pair of angularly spaced limit stops 122 and 123 which are adapted to engage an arm portion **117*a* of the actuating lever when the hoist limit drum is rotated, thus causing the actuating lever to pivot as the drum continues to rotate. The outer end of lever arm 117*a* is linked to an arm portion 124 of the crowd control lever by means of a linkage 125 which is smaller to linkage 73** described in connection with the hoist control lever biasing system including a preloaded compression spring assembly.

Figure 11:
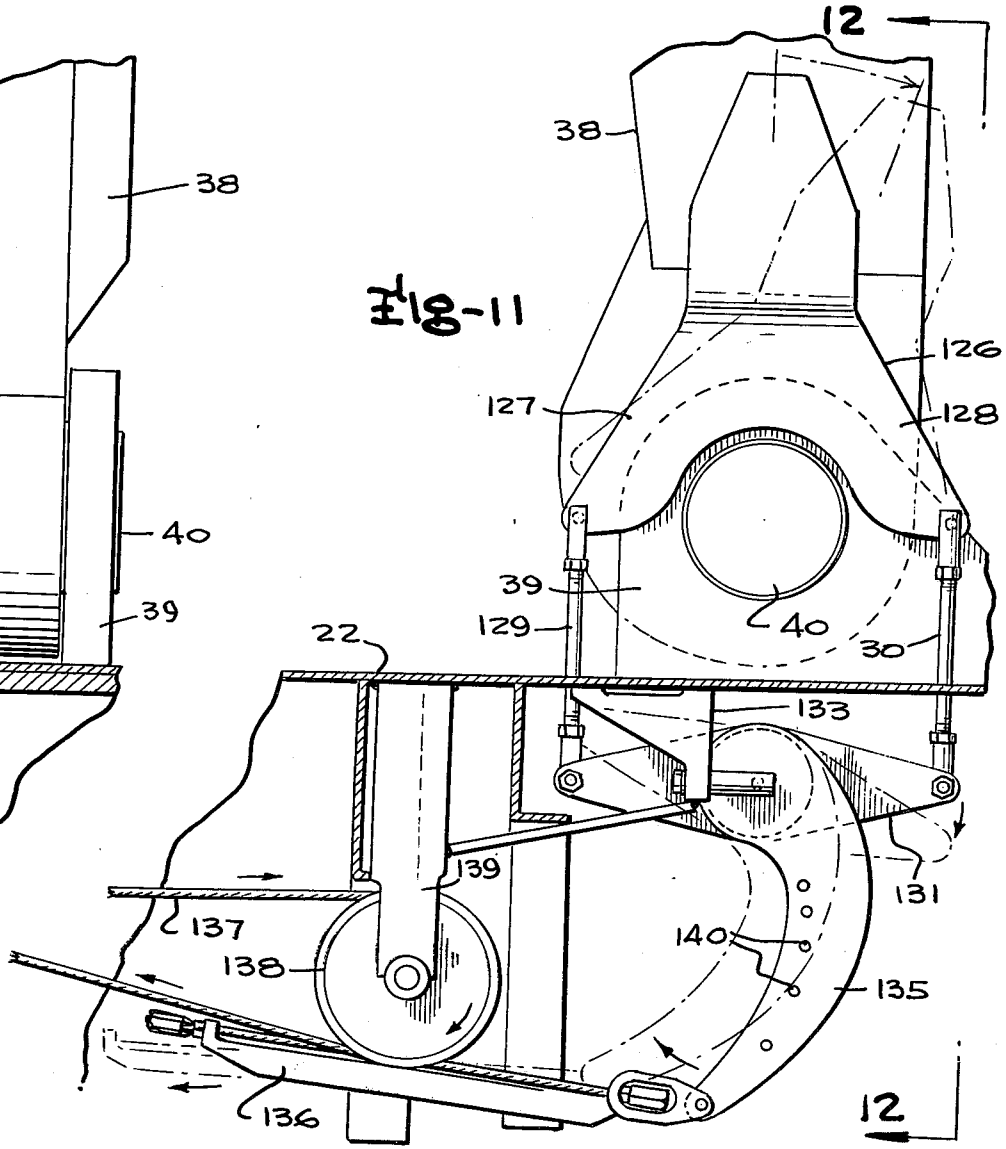
FIG. 11 is an enlarged, side elevational view of a ›ortion of the embodiment, operatively connected to he mast of the shovel.
Figure 12:
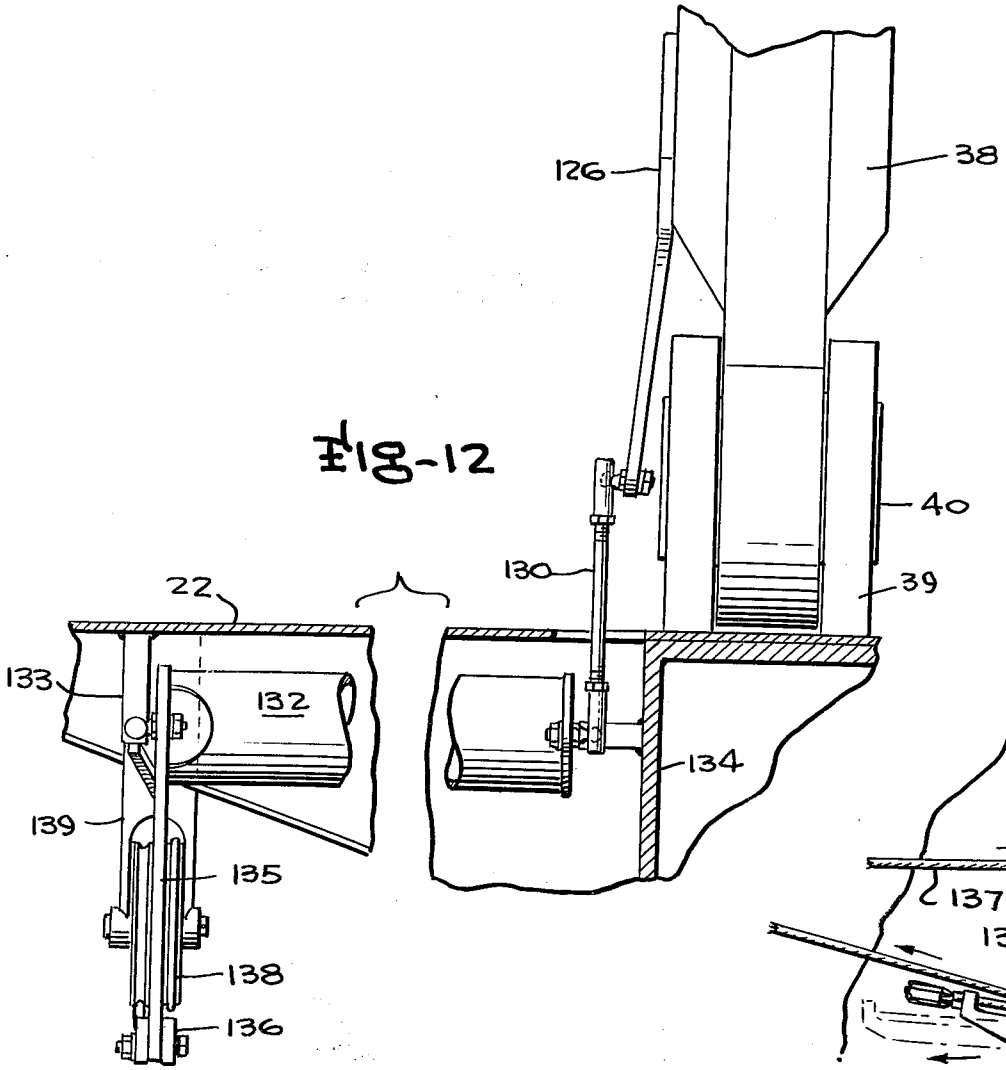
FIG. 12 is a cross-sectional view taken along 12—12 ı FIG. 11.
Figure 13:
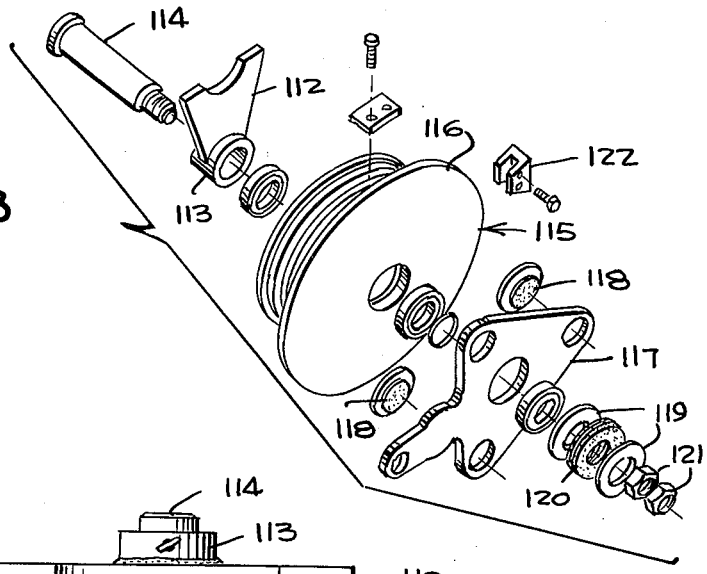
FIG. 13 is a perspective view of a crowd limit drum he embodiment and associated components, illus-rated in exploded relation.
Figure 14:
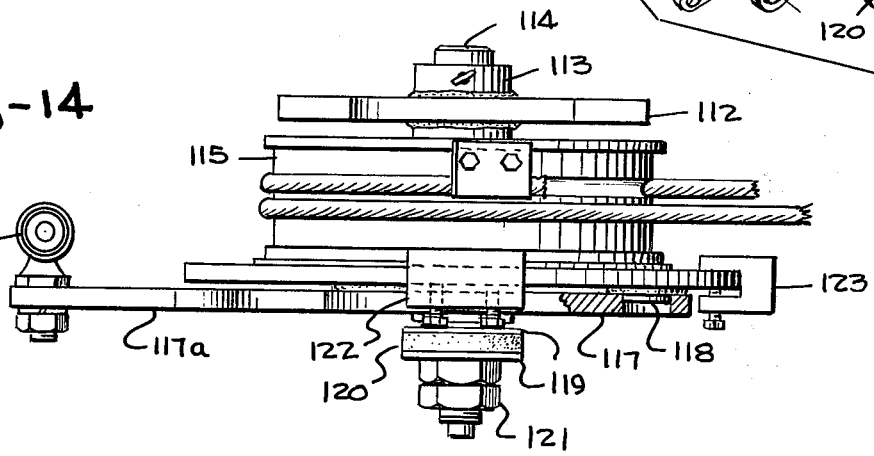
FIG. 14 is a top plan view of the crowd limit drum nd associated components.

For sensing the pivotal movement of mast 38 relative to the upper frame, there is provided a plate 126 rigidly secured to a side of the mast and provided with a pair of depending leg portions 127 and 128 which substantially straddle the upper end of the mast connecting pin. As best shown in FIGS. 11 and 12, a pair of links 129 and 130 are pivotally connected at their upper ends to the lower ends of leg portions 127 and 128 and project downwardly into the interior of the upper frame where they are pivotally connected to the arm of a lever 131. The lever is provided with a transversely disposed shaft 132 which is journaled at its ends in brackets 133 and 134 forming components of the structural framework of the upper frame. The outer end of shaft 132 is provided with an arcuate arm 135, the lower end of which is pivotally connected to a forwardly projecting support link 136. It thus will be seen that upon pivotal movement of mast 38, such motion will be transmitted through links 129 and 130, shaft 132 and be translated into rectilinear motion of support link 136.

The rectilinear motion of support link 136 is transmitted and translated into pivotal motion of the crowd limit drum by means of a wire rope 137 reeved about the crowd limit drum and a drum 138, and having the ends thereof dead ended on support link 136. Support link 136 is disposed substantially tangentially relative to drum 138. As best shown in FIGS. 1 and 11, wire rope 137 has one end dead ended on the rear end of support link 136, is reeved around sheave 138, extends forwardly and is reeved around crowd limit drum 115, extends rearwardly and is reeved around sheave 138, and then is dead ended at the forward end of support link 136. It will be appreciated that upon rectilinear movement of support link 136, wire rope 137 will be caused to move along the length thereof to correspondingly rotate the crowd limit drum. As shown in FIGS. 11 and 12, drum 138 is rotatably mounted on a depending bracket 139 rigidly secured to the structural framework of the upper frame, and arcuate arm 135 is provided with a series of holes 140 so that the rear end of support link 136 may be secured to the arcuate arm at a number of different radial distances from the axis of shaft 32, for adjustment purposes.

In the conventional operation of the type of shovel illustrated in FIG. 2, the swing machinery is first operated to swing the front end assembly in a forwardly disposed position with the stiffleg disposed along the longitudinal center line of the lower frame assembly. The crowd control lever is then moved rearwardly to the retract position and the hoist control lever is moved forwardly to a lowering position whereby the stiffleg is raised and the dipper handle is permitted to swing downwardly to position the dipper between the front ends of the crawler units with the heel of the dipper disposed adjacent the foot of the stiffleg and the dipper teeth disposed at grade level. The dipper is then positioned at the beginning of the crowd phase of a digging cycle and the pitch control mechanism is in the released condition thus permitting the dipper to pivot freely relative to the dipper handle.

To begin the digging cycle, the crowd control lever is moved forwardly to the crowd position and the hoist control lever simultaneously is moved to the hoist position causing the dipper to move forwardly and begin pitching upwardly. When the dipper reaches a horizontal attitude, the pitch control mechanism is operated to hold the pitch of the dipper in a horizontal attitude as the dipper continues to be hoisted and crowded into an embankment being excavated. As soon as the dipper reaches the maximum extent of its horizontal travel, the crowd control lever is moved to the retract position and the pitch control mechanism simultaneously is released. Under such conditions, the dipper will be retracted free of the embankment and will pitch upwardly until it engages pitch stop 35, the stiffleg will begin to be raised and the dipper will continue to be hoisted until it reaches an elevated dumping position. While the dipper is being raised to the dump position, the swing machinery may be operated to swing the dipper into position over a vehicle or other location where the excavated material is to be dumped. The door of the dipper is then unlatched to permit the material to be dumped. The dipper is then swung back into longitudinal alignment with the lower frame of the shovel while the hoist control lever is moved forwardly to the lowering position to reposition the dipper adjacent the foot of the stiffleg to begin another digging cycle.

In the digging cycle as described and also during other motions of the dipper, the system illustrated in FIG. 1 assists the operator in causing the dipper to travel to its full limits of movement without exceeding such limits thus increasing the efficiency of shovel while preventing any structural damage to the components thereof. In this regard, when the dipper is disposed at the starting position with the heel thereof disposed adjacent the foot of the stiffleg and the dipper teeth disposed at grade level, and the crowd control lever is moved forwardly to the crowd position and the hoist control lever is moved rearwardly to the hoist position, simultaneously, crowd control lever arm 124 will be pivoted downwardly to cause actuating lever 117 to correspondingly pivot downwardly to the position illustrated in phantom lines in FIG. 15, and hoist control lever arm 72 will be pivoted upwardly to correspondingly pivot floating lever 67 and actuating lever 63 upwardly. As the dipper is moved forwardly and crowded into an embankment, mast 38 simultaneously will be caused to pivot forwardly. Such pivotal movemment will be transmitted through the linkage interconnecting plate 126 and hoist limit drum 115 so that the drum will be caused to rotate in a clockwise direction relative to FIG. 15. As the dipper approaches the outer limit of its travel, mast 38 correspondingly will approach the limit of its travel and such motion will be transmitted to the crowd limit drum. The rotation of drum 115 correspondingly will cause limit stop 123 to engage the underside of actuating lever arm 117*a*. Further movement of the dipper toward its limit of travel will cause pivot stop 123 to pivot actuating lever arm 117*a* upwardly. Such motion is transmitted through linkage 125 to the crowd control lever. Because of the preloaded spring arrangement incorporated in linkage 125, the force exerted on the crowd control lever will increase steadily, biasing the crowd control lever rearwardly away from the crowd position and toward the neutral position thereof. Such steadily increasing force on the crowd control lever functions not only as a feedback to shift the position of the lever toward neutral but further to provide a physical warning to the operator that the limit of travel of the dipper is being approached.

At the end of the crowd phase of the cycle when the crowd control lever is moved rearwardly to the retract position, crowd control lever arm 124 is caused to pivot upwardly thus causing actuating lever arm 117*a* to pivot upwardly or in a clockwise direction relative to FIG. 15. Simultaneously with the upward pivotal movement of the stiffleg, mast 38 will be caused to pivot rearwardly. Such rearwardly pivotal motion of the mast then is transmitted from plate 126 to crowd limit drum 115 causing the drum to rotate in a counterclockwise direction relative to FIG. 15. As the mast approaches its rearward limit of travel, crowd limit drum 115 will rotate counterclockwise sufficiently to cause limit stop 122 to engage the upper side of actuating lever arm 117*a* causing it to pivot downwardly. As the mast continues to be retracted and approach its limit, a steadily increasing force will be transmitted by linkage 125 to the crowd control lever, biasing the lever forwardly away from the retract position and toward the neutral position. Under such circumstances, not only will automatic limiting action occur, preventing the mast from exceeding its structural limit, but the operator will be physically warned of the approach of the mast to such limit.

As previously mentioned in connection with the description of a normal digging cycle of the machine, the hoist control lever is moved to the hoist position at the beginning of the digging cycle and remains at such position until the dipper is elevated to a dumping position. As this occurs, the hoist frame is caused to pivot upwardly relative to the stiffleg. Such pivotal motion of the hoist frame relative to the stiffleg is transmitted through drum 91 and wire rope 90 to hoist limit drum 60, causing the drum to rotate in a counterclockwise direction relative to FIGS. 7 and 8. As the dipper approaches its upper limit corresponding to its dumping position, limit stop 68*a* will engage actuating lever 63 causing actuating lever 63 and floating lever 67 to pivot downwardly. Such downwardly pivotal motion is transmitted through linkage 73 providing a steadily increasing downward force on the hoist control lever, causing the lever to move forwardly away from the hoist position and toward the neutral position thereof. Such action provides an automatic limiting action with respect to the hoisting phase of the cycle and simultaneously physically warns the operator of the approach of such upper limit.

After the load in the dipper has been dumped and the hoist control lever is moved forwardly to the lowering position to reposition the dipper at the beginning of the digging cycle, the hoist frame will be caused to pivot downwardly relative to the stiffleg. Such pivotal motion will be transmitted by drum 91 and wire rope 90 to the hoist limit drum, causing it to rotate in a clockwise direction relative to FIGS. 7 and 8. A the hoist frame pivots downwardly, and approaches a lower limit, the hoist limit drum will rotate sufficiently to cause limit stop 68 to engage the underside of actuating lever 63. As the hoist frame continues to approach its lower limit of travel and drum 62 correspondingly continues to ıtate and the rear end of floating lever 67 encounters sistance from bell crank lever 105, actuating lever 63 ıd floating lever 67 will be caused to pivot upwardly. ıch pivotal motion will be transmitted through link-;e 73, causing a steadily increasing force to be applied the hoist control lever, biasing the lever rearwardly vay from the lowering position to the neutral position. Under conditions where the stiffleg is out of alignent with the ends of the crawler units, follower 99 of wer limit shifting system 53 will be out of engagement ıth any lobes 95 through 98 and correspondingly bell ank lever 105 will be free to pivot upwardly to a ›sition illustrated in FIG. 8. Under such conditions, e engagement of limit stop 68 with the underside of tuating lever 63 will cause floating lever 67 to pivot lative to actuating lever 63, provide a lost motion ›tween stop 68 and linkage 73. Continued rotation of um 60 will cause the rearward end of floating lever ' to pivot upwardly until abutment 71 engages limit ›p 109. From such point on, continued clockwise tational movement of the hoist limit drum will cause tuating lever 63 and floating lever 67 to pivot upıdly and transmit motion to linkage 73.

In the event, however, the front end assembly is 'ung to a position whereby the stiffleg is in alignment th one of the ends of the crawler units, follower 99 ll be caused to move radially outwardly relative to e center journal, causing bell crank lever 105 to pivot a counterclockwise direction an assume a position as ustrated in FIG. 7. Under such conditions, as soon as nit stop 68 engages actuating lever 63 and continues rotate, there will be no lost motion between stop 68 d linkage 73 and both of the floating and actuating vers will simultaneously be caused to pivot upwardly, stantaneously transmitting a motion to linkage 73. It us will be seen that the effect of lower limit shifting stem is to shift the lower limit of the hoist upwardly to event the dipper from striking the ends of the crawler ıits. In effect, system 53 advances in time the autoatic limiting and warning action required to avoid iving the dipper into the crawler ends.

When the hoist and crowd control levers are posi›ned in neutral, actuating levers 63 and 115 similarly sume neutral position. Whenever, the control levers e moved to operative positions, such motions are ınsmitted through the feedback linkages to angularly ›place levers 63 and 115. Upon rotation of the hoist d crowd limit drums, the limit stops provided thereon ll engage and return levers 63 and 115 to their neuıl positions thereby transmitting forces through the ›dback linkages to bias the control levers toward the utral positions thereof, as previously described.

As a feedback linkage is moved in either direction by actuating lever, the center spring thereof initially ll be compressed, exerting about 16 pounds initial essure on the control lever. If the operator does not ›pond to the increasing lever resistence, the secony springs will be compressed, increasing the lever essure to about 30 pounds. Should the secondary rings be allowed to bottom out, the lever will be used to move even more forceably toward the neuıl position.

The system as described not only provides a steadily creasing feedback force when a limit is approaching t also provides a slight frictional drag against the ›vement of the crowd control lever. The direction of ch drag friction is such that when the operator reves his hand from the lever, the motion stops itself by moving the control lever back toward neutral to the exact position required to hold the load motionless. The lever will automatically seek and find the hold position because any movement of the crowd system causes the control lever to move in a direction operative to counteract such movement. The system thus constitutes a part of a closed-loop servomechanism, subject to the physical laws governing the stability of such systems.

Although the embodiment described utilizes a combination of wire ropes, drums and sheaves for transmitting motion from the structural members, i.e. the mast and hoist frame, to the control levers, any number of motion transmitting mechanisms may be used for such purposes including selsyns or hydraulic transmitters of the type utilized in automotive brake controls. It has been found, however, that the use of wire rope as a motion transmitting component is best in performance in that it is easy to design a wire rope system with minimum deflection and no variable backlash. Minimal deflection is essential in the operation of the system because the object of the system is to provide the operator with a steadily increasing lever force and not a gradual buildup from zero as would be the case if the linkage stretched appreciably under load. Backlash can be tolerated on the hoist so long as it does not change as the parts thereof wear but cannot be tolerated in the crowd.

The aforementioned self-holding servo action is applied only to the crowd in that the crowd is hydrostatically operated and can hold a load motionless indefinitely by simply pumping enough oil into the crowd cylinders to make up for internal leakage. It thus will be appreciated that the crowd control system does not develop backlash because any such backlash will cause "hunting" or unstable servo action.

It is to be noted that follower 99 of the lower limit shifting system normally is positioned entirely away from cam 94 due to the action of counterweight 110 provided on bell crank lever 105. The follower is caused to approach the cam only when the hoist motion approaches its lower limit. If the follower approaches a lobe on a corner of the cam, its motion is restricted and a feedback force begins to build up. If the follower approaches between a pair of lobes, it will not engage the cam, since the pivotal movement of bell crank lever 105 is restricted by set screw 111. Such arrangement prevents undue wear on the follower and cam which are located in a rather inaccessible area.

With respect to the operation of the hoist or crowd control lever biasing systems, it further is to be noted that when either the mast of hoist frame approaches either of its limits of travel whereby motion is transmitted through the biasing system, the feedback force imposed on the respective lever initially will increase sharply at a comparatively high rate untill the center spring of the feedback linkage begins to compress. Such action functions to initially physically alert the operator of an approach to a motion limit of the machine. As the center spring is compressed, the feedback force imposed on the lever will continue to increase but at a comparatively lower rate depending on the spring rate of the center spring until the center spring has bottomed out. The feedback force then increases at a comparatively higher rate until the secondary or overload springs begin to compress. While the overload springs are compressed, the feedback force again will increase at the comparatively lower rate until the overload springs bottom out. The feedback force then increases at the comparatively higher rate for the balance of movement of the lever. Thus, it will be seen that the feedback force is imposed on the control levers not only in an increasing and steady manner but also at different rates depending upon the spring rates of the springs provided in the feeback linkages.

From the foregoing detailed description, it will be evident that there are a number of changes, adaptations and modifications of the present invention which come within the province of those persons having ordinary skill in the art. However, it is intended that all such variations not departing from the spirit of the invention be considered as within the scope thereof and as limited solely by the appended claims.

We claim:

1. In a power shovel including a lower frame provided with a pair of transversely spaced crawler units and a center journal; an upper frame mounted on said lower frame for rotational moveement about said center journal; means mounted on said upper and lower frames for rotating said upper frame relative to said lower frame; a front end assembly mounted on said upper frame, said front end assembly including a stiffleg pivotally connected at an inner end thereof to said upper frame, a dipper handle operatively connected to said stiffleg for pivotal movement relative thereto and a dipper pivotally connected to said dipper handle; a system mounted on said upper frame and operatively connection to said front end assembly for crowding and retracting said dipper, said crowd system including a coomponent movable between predetermined limits proportionally corresponding to predetermined crowd and retract limits of said dipper; a control lever mounted on said upper frame and operatively connected to means for actuating said crowd system, said control lever having operative crowd and retract positions and a neutral position intermediate said crowd and retract positions; a system mounted on said upper frame and operatively connected to said front end assembly for hoisting and lowering said dipper whereby said dipper handle is caused to pivot reltaive to said stiffleg, said hoist system including a component movable between predetermined limits proportionally corresponding to predetermined upper and lower limits of movement of said dipper handle relative to said stiffleg during the hoisting and lowering of said dipper; and a control lever mounted on said upper frame and operatively connected to means for actuating said hoist system, said hoist control lever having operative lowering and hoist positions and a neutral position intermediate said lowering and hoist positions; a system for limiting the motions of said dipper comprising means operatively interconnecting said crowd component and said crowd control lever responsive to a movement of said crowd component between said predetermined limits of movement thereof for increasingly biasing said crowd lever steadily away from an operative position thereof, as said crowd component approaches one of said predetermined limits of movements thereof, and means operatively interconnecting said hoist control lever and said hoist component responsive to a movement of said hoist component between the limits of movement thereof for increasingly biasing said hoist control lever steadily away from an operative position thereof, as said hoist component approaches one of said predetermined limits of movement thereof, whereby the operator is physically alerted to the proximity to the limit of travel of the hoist or crowd components by the increasing force on the control lever tending to move it towards its neutral position as the hoist or crowd components approach the said limit.

2. A system according to claim 1 wherein said means for biasing said crowd control lever steadily away from an operative position thereof comprises a mechanical linkage including a preloaded compression spring.

3. A system according to claim 1 wherein said crowd component comprises a mast pivotally connected to said upper frame and operatively connected to said front end assembly, and wherein said means for biasing said crowd control lever steadily away from an operative position thereof comprises a mechanical linkage, said linkage including a crowd limit drum rotatably mounted on a shaft supported on said upper frame, a crowd limit actuating lever pivotally mounted on said crowd limit drum shaft, a link including a preloaded compression spring interconnecting said crowd limit actuating lever and an arm of said crowd control lever, said crowd limit drum having circumferentially spaced limit stops engageable with said crowd limit actuating lever whereby upon rotation of said crowd limit drum relative to said crowd limit actuating lever, said limit stops will engage and pivot said actuating lever, and means for transmitting pivotal motion of said mast to said crowd limit drum.

4. A system according to claim 3 wherein said means for transmitting pivotal motion of said mast to said crowd limit drum includes a second drum rotatably supported on said upper frame, a support link disposed substantially tangentially relative to said second drum, means operatively interconnecting said mast and said support link for translating pivotal motion of said mast to rectilinear motion of said support link substantially along the length thereof, and a rope having the ends thereof secured to said support link and reeved about said second drum and said crowd limit drum whereby upon rectilinear movement of said support link, said rectilinear motion of said support link will be translated into rotational motion of said crowd limit drum.

5. A system according to claim 3 wherein said crowd limit actuating lever is yieldably biased into engagement with said crowd limit drum to provide a frictional drag therebetween.

6. A system according to claim 1 wherein said means for biasing said hoist control lever steadily away from an operative position thereof comprises a mechanical linkage including a preloaded compression spring.

7. A system according to claim 1 wherein said hoist component comprises one of said dipper handle and a hoist frame pivotally connected to said dipper and connected to said dipper by a hoist link, with said dipper handle pivotally connected to one fo said stiffleg and said hoist frame, and wherein said means for biasing said hoist control lever steadily away from an operative position thereof comprises a mechanical linkage, said linkage including a hoist limit drum rotatably mounted on a shaft supported on said upper frame, a hoist limit actuating lever operative connected to said hoist limit drum shaft for pivotal movement relative to the axis thereof, a link including a preloaded compression spring operatively interconnecting said hoist limit actuating lever and an arm of said hoist control lever, said hoist limit drum having circumferentially spaced limit stops operatively engageable with said hoist limit actuating lever whereby upon rotation of said hoist limit drum, said limit stops will operatively engage and pivot said actuating lever, and means for transmitting pivotal motion of said on of said dipper handle and hoist frame to said hoist limit drum.

8. A system according to claim 7 wherein said means for transmitting pivotal motion of said one of said dipper handle and said hoist frame includes a second drum mounted on said one of said dipper handle and said hoist frame for pivotal movement about the axis of pivotal movement of said dipper handle relative to said stiffleg, and a rope reeved about said second drum and said hoist limit drum for transmitting pivotal motion of said second drum relative to said stiffleg to said hoist limit drum.

9. A system according to claim 8 including sheaves for guiding said motion transmitting rope from said second drum mounted on said one of said dipper handle and said hoist frame, along said stiffleg, transversely and rearwardly to said hoist limit drum.

10. A system according to claim 1 including means operatively connected to said hoist control lever biasing means, responsive to predetermined angular displacements of said upper frame relative to said lower frame for conditioning said hoist control lever biasing means to advance in time the biasing of the hoist control lever away from the lowering position thereof.

11. A system according to claim 10 wherein said conditioning means includes a cam rigidly mounted on said center journal provided with angularly spaced lobes, a follower pivotally mounted on said upper frame, engageable by said lobes, and means operatively interconnecting said follower and said hoist control lever biasing means for transmitting a motion of said follower to said hoist control lever biasing means to condition said biasing means to commence earlier in biasing said hoist control lever away from the lowering position thereof.

12. A system according to claim 10 wherein said means for biasing said hoist control lever steadily away from an operative position thereof comprises a mechanical linkage including a preloaded compression spring.

13. A system according to claim 12 wherein said conditioning means includes a cam rigidly mounted on said center journal provided with angularly spaced lobes, a follower pivotally mounted on said upper frame engageable by said lobes, and means operatively interconnecting said follower element and said mechanical linkage for transmitting a motion of said followers to said hoist control lever biasing means to condition said mechanical linkage.

14. A system according to claim 10 wherein said means for biasing said hoist control lever steadily away from an operative position thereof comprises a mechanical linkage, said linkage including a hoist limit drum rotatably mounted on a shaft supported on said upper frame, an actuating lever pivotally mounted on said hoist limit drum shaft, a floating lever pivotally mounted intermediate the ends thereof on said actuating lever, a link including a preloaded pressure spring interconnecting an end of said actuating lever and an arm of said hoist control lever, and said hoist limit drum having circumferentially spaced limit stops engageable with said actuating lever whereby upon rotation of said hoist limit drum relative to said actuating lever, said limit stops will engage and pivot said actuating and floating levers to transmit corresponding motion to said hoist control lever.

15. A system according to claim 14 wherein said conditioning means includes a cam rigidly mounted on said center journal provided with angularly spaced lobes, a follower pivotally mounted on said upper frame, engageable with said lobes to pivot said follower, a bell crank lever mounted on said upper frame having a first arm engageable with a free end of said floating lever and a second arm, and means operatively interconnecting said follower and said bell crank lever for transmitting the pivotal motion of said follower to said second bell crank lever arm whereby upon engagement of one of said lobes by said follower, pivotal movement of said follower will be transmitted to said bell crank lever to restrict said pivotal movement of said floating lever relative to said actuating lever and transmit a motion to said hoist control lever to bias said hoist control lever away from the lowering position thereof.

16. In a power shovel including a lower frame provided with a pair of transversely spaced crawler units and a center journal; an upper frame mounted on said lower frame for rotational movement about said center journal; means mounted on said upper and lower frame for rotating said upper frame relative to said lower frame; a front end assembly mounted on said upper frame, said front end assembly including a stiffleg pivotally connected at an inner end thereof to said upper frame, a dipper handle operatively connected to said stifflet for pivotal movement relative thereto and a dipper pivotally connected to said dipper handle; a system mounted on said upper frame and operatively connected to said front end assembly for crowding and retracting said dipper, said crowd system including a component movable between predetermined crowd and retract limits proportionally corresponding to predetermined limits of movement of said dipper; a control lever mounted on said upper frame and operatively connected to means for actuating said crowd system, said control lever having operative crowd and retract positions and an intermediate neutral position; and a system mounted on said upper frame and operatively connected to said front end assembly for hoisting and lowering said dipper; a system for limiting the motions of said dipper comprising means operatively interconnecting said crowd component and said crowd control lever responsive to a movement of said crowd component between said predetermined limits for increasingly biasing said crowd control lever steadily away from an operative position thereof, as said crowd component approaches one of said predetermined limits of movement thereof, whereby the operator is physically alerted to the proximity to the limit of travel of the crowd components by the increasing force on the control lever tending to move it towards its neutral position as the crowd components approach the said limit.

17. A system according to claim 16 wherein said means for biasing said crowd control lever steadily away from an operative position thereof comprises a mechanical linkage including a preloaded compression spring.

18. A system according to claim 16 wherein said crowd component comprises a mast pivotally connected to said upper frame and operatively connected to said front end assembly, and wherein said means for biasing said crowd control lever steadily away from an operative position thereof comprises a mechanical linkage, said linkage including a crowd limit drum rotatably mounted on a shaft supported on said upper frame, a crowd limit actuating lever pivotally mounted on said crowd limit drum shaft, a link including a preloaded compression spring interconnecting said crowd limit actuating lever and an arm of said crowd control lever; said crowd limit drum having circumferentially spaced limit stops engageable with said crowd limit actuating lever whereby upon rotation of said crowd limit drum, said limit stops will engage and pivot said actuating lever, and means for transmitting pivotal motion of said mast to said crowd limit drum.

19. A system according to claim 18 wherein said means for transmitting pivotal motion of said mast to said crowd limit drum includes a second drum rotatably supported on said upper frame, a support link disposed substantially tangetially relative to said second drum, means operatively interconnecting said mast and said support link for translating pivotal motion of said mast to rectilinear motion of said support link substantially along the length thereof, and a rope having the ends thereof secured to said support link and reeved about said second drum and said crowd limit drum whereby upon rectilinear movement of said support link, said rectilinear motion of said support link will be translated into rotational motion of said crowd limit drum.

20. A system according to claim 18 wherein said crowd limit actuating lever is yieldingly biased into engagement with said crowd limit drum to provide a frictional drag therebetween.

21. In a power shovel including a lower frame provided with a pair of transversely spaced crawler units and a center journal; an upper frame mounted on said lower frame for rotational movement about said center journal; means mounted on said upper and lower frames for rotating said upper frame relative to said lower frame; a front end assembly mounted on said upper frame, said front end assembly including a stiffleg pivotally connected at an inner end thereof to said upper frame, a dipper handle operatively connected to said stiffleg for pivotal movement relative thereto and a dipper pivotally connected to said dipper handle; a system mounted on said upper frame and operatively connected to said front end assembly for crowding and retracting said dipper; a system mounted on said upper frame and operatively connected to said front end assembly for hoisting and lowering said dipper whereby said dipper handle is caused to pivot relative to said stiffleg, said hoist system including a component movable between predetermined limits proportionally corresponding to predetermined upper and lower limits of movement of said dipper handle relative to said stiffleg during the hoisting and lowering of said dipper; and a control lever mounted on said upper frame and operatively connected to means for actuating said hoist system, said hoist control lever having operative lowering and hoist positions and an intermediate neutral position; a system for limiting the motions of said dipper comprising means operatively interconnecting said hoist control lever and said hoist component responsive to movement of said hoist component between said limits of movement thereof for increasingly biasing said hoist control lever steadily away from an operative position thereof as said hoist component approaches one of said predetermined limits of movement thereof, whereby the operator is physically alerted to the promixity to the limit of travel of the hoist components by the increasing force on the control lever tending to move it towards its neutral position as the hoist components approach the said limit.

22. A system according to claim 21 wherein said means for biasing said hoist control lever steadily away from and an operative position thereof comprises a mechanical linkage including a preloaded compression spring.

23. A system according to claim 21 wherein said hoist component comprises one of said dipper handle and a hoist frame pivotally connected to said stiffleg and connected to said dipper by a hoist link, with said dipper handle pivotally connected to one of said stiffleg and said hoist frame and wherein said means for biasing said hoist control lever steadily away from an operative position thereof comprises a mechanical linkage, said linkage including a hoist limit drum rotatably mounted on a shaft supported on said upper frame, a hoist limit actuating lever operatively connected to said hoist limit drum shaft for pivotal movement relative thereto, a link including a preloaded compression spring interconnecting said hoist limit actuating lever and an arm of said hoist control lever, said hoist limit drum having circumferentially spaced limit stops operatively engageable with said hoist limit actuating lever whereby upon rotation of said hoist limit drum, said limit stops will operatively engage and pivot said actuating lever, and means for transmitting pivotal motion of said one of said dipper handle and said hoist frame to said hoist limit drum.

24. A system according to claim 21 wherein said means for transmitting pivotal motion of said one of said dipper handle and said hoist frame includes a second drum mounted on said one of said dipper handle and said hoist frame for pivotal movement about the axis of pivotal movement of said dipper handle relative to said stiffleg, and a rope reeved about said second drum and said hoist limit drum for transmitting pivotal motion of said second drum relative to said stiffleg to said hoist limit drum.

25. A system according to claim 24 including sheaves for guiding said motion transmitting rope from said drum mounted on said one of said dipper handle and said hoist frame, along said stiffleg, transversely and rearwardly to said hoist limit drum.

26. A system according to claim 21 including means operatively connected to said hoist control lever biasing means responsive to predetermined angular displacements of said upper frame relative to said lower frame for conditioning said hoist control lever biasing means to advance in time the biasing of the hoist control lever away from the lowering position thereof.

27. A system according to claim 26 wherein said conditioning means includes a cam rigidly mounted on said center journal provided with angularly spaced lobes and a follower pivotally mounted on said upper frame engageable by said lobes for sensing said predetermined angular displacements.

28. A system according to claim 26 wherein said means for biasing said hoist control lever steadily away from and an operative position thereof comprises a mechanical linkage including a preloaded compression spring.

29. A system according to claim 28 wherein said means includes a cam rigidly mounted on said center journal provided with angularly spaced lobes, a follower pivotally mounted on said upper frame engageable by said lobes, and means operatively interconnecting said follower and said mechanical linkage for transmitting a motion of said follower to said hoist control ever biasing means to condition said mechanical linkge.

30. A system according to claim 27 wherein said neans for biasing said hoist control lever steadily away rom an operative position thereof comprises a mehanical linkage, said linkage including a hoist limit lrum rotatably mounted on a shaft supported on said pper frame, an actuating lever pivotally mounted on aid hoist limit drum shaft, a floating lever pivotally nounted intermediate its ends on said actuating lever, link including a preloaded compression spring interonnecting an end of said floating lever and an arm of aid hoist control lever, and said hoist limit drum havng circumferentially spaced limit stops engageable vith said actuating lever whereby upon rotation of said oist limit drum, said limit stops will engage and pivot aid actuating and floating levers to transmit correponding motion to said hoist control lever.

31. A mechanism according to claim 30 wherein said onditioning means includes a cam rigidly mounted on center journal provided with angularly spaced lobes, follower pivotally mounted on said upper frame enageable with said lobes to pivot said follower, a bell rank lever mounted on said upper frame having a first rm engageable with a free end of said floating lever nd a second arm, and means operatively interconnectng said follower and said bell crank lever for transmiting the pivotal motion of said follower to said second bell crank arm whereby upon engagement of one of said lobes by said follower, the pivotal movement of said follower will be transmitted to said bell crank lever to restrict pivotal movement of said actuating lever relative to said floating lever and transmit motion to said hoist control lever to bias said hoist control lever away from the lowering position thereof.

32. A system according to claim 1 wherein at least one of said crowd and hoist control lever biasing means includes means for applying a force on the control lever thereof initially at a predetermined high rate whereby a sudden motion is applied to said control lever to physically alert the operator of an approach to a motion limit.

33. A system according to claim 16 wherein said crowd control lever biasing means includes means for applying a force on the control lever thereof initially at a predetermined high rate whereby a sudden motion is applied to said control lever to physically alert the operator of an approach to a motion limit.

34. A system according to claim 21 wherein said hoist control lever biasing means includes means for applying a force on the control lever thereof initially at a predetermined high rate whereby a sudden motion is applied to said control lever to physically alert the operator of an approach to a hoist motion limit.

* * * * *

UNITED STATES PATENT AND TRADEMARK OFFICE

CERTIFICATE OF CORRECTION

PATENT NO. : 3,976,211

DATED : August 24, 1976

INVENTOR(S) : George B. Baron et al

It is certified that error appears in the above-identified patent and that said Letters Patent are hereby corrected as shown below:

Column 2, line 31, delete "auatomatically" and insert --automatically--;
line 62, delete "FIg" and insert--FIG--.
Figure 2, crowd system cylinders should be identified as --44-- not "48".
Column 3, line 65, insert --'-- after "45".
Figure 2 insert --'-- after "45" for bracket.
Column 4, line 10, delete "supported" and insert --supplied--;
line 15, delete "1" and insert --2--.
Column 5, line 16, delete "69" and insert --59--;
line 26, delete "67 and 68" and insert --68 and 68a--.
Figures 6, 8 & 9 insert --'-- after "68" for stub shaft.
Column 5, lines 33 and 39 insert --'-- after "68".
Figure 7, change identifier "71" on L-shaped stop mounted on actuating lever 63 to --70--.
Figure 9 lead line from identifier 71 should extend to abutment element as shown in Figure 6.
Column 6, line 11, delete "in" and insert--is--;
line 28, insert --, as shown in Figure 1,-- after "91";
line 32, delete "92" and insert --93--;
line 33, insert --60-- after "hoist limit drum";
line 62, delete "a".
Column 8, line 9, delete "smaller" and insert--similar--;
line 21, delete "arm" and insert--arms--.
Column 10, line 63, delete "A" and insert--As--;
line 69, delete "62" and insert--60--.
Column 11, line 29, delete "an" and insert--and--;
line 36, insert--the-- after "of";
lines 43, 47 and 49, delete "115" and insert--117--.
Column 12, line 56, delete "untill" and insert--until--.
Column 13, line 20, delete "moveement" and insert--movement--;

UNITED STATES PATENT AND TRADEMARK OFFICE

CERTIFICATE OF CORRECTION

PATENT NO. : 3,976,211

DATED : August 24, 1976

INVENTOR(S) : George B. Baron et al

It is certified that error appears in the above-identified patent and that said Letters Patent are hereby corrected as shown below:

Column 13, line 32, delete "coomponent" and insert--component--;
line 42, delete "reltaive" and insert--relative--.
Column 14, line 54, delete "fo" and insert--of--.
Column 15, line 2, delete "on" and insert--one--.
Column 16, line 29, delete "stifflet" and insert--stiffleg--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*